United States Patent [19]

Ferguson

[11] Patent Number: 4,723,868

[45] Date of Patent: Feb. 9, 1988

[54] APPARATUS FOR INSTALLING CIRCULAR TRAFFIC LOOPS

[76] Inventor: Ralph C. Ferguson, 13154 Yerba St., North Hollywood, Calif. 91605

[21] Appl. No.: 895,727

[22] Filed: Aug. 12, 1986

[51] Int. Cl.[4] ..... E01C 23/12

[52] U.S. Cl. ..... 404/90; 404/86; 299/41; 173/28; 175/330

[58] Field of Search ..... 299/41, 36, 39; 404/71, 404/72, 75, 9, 112, 86, 87, 90, 93, 128; 175/330, 122, 203; 173/28; 37/2 R

[56] References Cited

U.S. PATENT DOCUMENTS

| | | | |
|---|---|---|---|
| 3,107,460 | 10/1963 | Staehlin | 299/39 |
| 4,068,396 | 1/1978 | Langguth | 37/2 R |
| 4,239,415 | 12/1980 | Blikken | 404/75 |
| 4,273,384 | 6/1981 | Freeburn | 299/41 |
| 4,274,769 | 6/1981 | Multakh | 175/330 X |
| 4,433,871 | 2/1984 | Bertrand | 299/41 |
| 4,458,949 | 7/1984 | Jury | 299/41 |

FOREIGN PATENT DOCUMENTS

| | | | |
|---|---|---|---|
| 142277 | 5/1985 | European Pat. Off. | 299/39 |
| 450559 | 9/1975 | U.S.S.R. | 37/2 R |

*Primary Examiner*—Stephen J. Novosad
*Assistant Examiner*—John F. Letchford
*Attorney, Agent, or Firm*—Elliott N. Kramsky

[57] ABSTRACT

Apparatus for cutting a circular trough in a roadway whereby a traffic detection loop can be embedded with an advantageous round configuration. A frame for rotatably mounting a circular drill bit is pivotally engaged to a movable platform such as a single axle chassis. Hydraulic rams and hand-operated jacks engaged to the frame are provided for precise levelling and positioning of the circular drill bit. A hydraulically actuated motor drives the bit while a hydraulic ram adjusts downward cutting pressure. The unit is easily transported from location to location and the advantageous round shape is reliably and repeatedly achieved with great efficiency and speed.

5 Claims, 7 Drawing Figures

APPARATUS FOR INSTALLING CIRCULAR TRAFFIC LOOPS

BACKGROUND OF THE INVENTION

1. Field of the Invention

The present invention relates to apparatus for use in the installation of electomagnetic fields for traffic measurement and control purposes within a roadway. More particularly, this invention pertains to a mobile unit for installing circular traffic detector loops.

2. Description of the Prior Art

The traffic detector loop is in common usage for measuring and controlling roadway traffic flows. The loop or coil functions as a component of a tuned circuit. A flow of current through the conductive loop(s) produces a radiation pattern that interacts with metal objects, such as passing automobiles that detune the tuned circuit. The inductance of the coil or loop causes the flow of current therein to respond to the passage of the automobile and such variation in the flow is sensed by electrical measuring and/or control apparatus linked thereto.

The usefulness of detector loop information for controlling lights and studying traffic patterns follows, for example, from the presence of more than 250,000 light controlled intersections in congested Southern California roadways. Presently, as many as twenty-five (25) loops are in use at some intersections.

The loops are installed in both concrete and asphalt roadways. Each loop comprises an approximately one-half inch diameter conductor. The conductor is positioned in a one and one-half to three inch deep trough and is covered with a bituminous or soft epoxy sealant.

At the present time, the troughs for the loops are formed by sawing eight sided figures into the roadway with planar flat saws. Such a process is inefficient in terms of both labor cost and speed. More significantly, the resultant shape of the loop produced is inherently inappropriate for reliable detection of traffic. The corners of the octagonal shape are insensitive to flow as a result of static interference between the fields that surround the intersecting segments.

SUMMARY

The present invention overcomes the foregoing and additional shortcomings of the prior art by providing mobile apparatus for cutting a regular circular trough of predetermined width, depth and diameter in a roadway for installing a traffic loop. Such apparatus includes a chassis that is supported by a set of wheels. A drill bit has a circular cutting surface in accordance with the predetermined width and diameter of the trough. Means are provided for supporting the drill bit as are means for driving the last-named means between a traveling position and a cutting position. The supporting means is engaged to the rear end of the chassis so that, in the cutting position, the drill bit is outside the set of wheels and is arranged so that, in the traveling position, the cutting surface of the drill bit is substantially vertical and, in the cutting position, the cutting surface is substantially horizontal.

The preceding and other features and advantages of this invention will become further apparent from the description that follows. This description is accompanied by and references a set of drawing figures that includes numerals, corresponding to numerals of the written description, which point to the various features of this invention. Like numerals refer to like features thoroughout both the figures and the written description.

DETAILED DESCRIPTION

Figure 1:
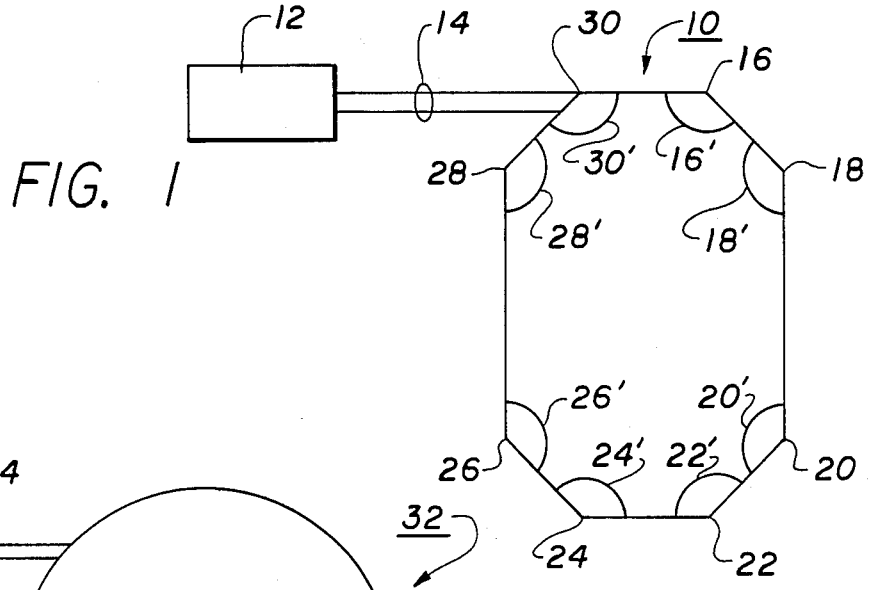
FIG. 1 is a plan view of a traffic loop as positioned in a trough formed in accordance with the prior art.

Turning now to the drawings, FIG. 1 is a top plan view of traffic loop 10 arranged in accordance with the prior art. The single loop 10 comprises three or four overlying turns of wire arranged into a generally octagonal shape and positioned between one and one-half and three inches beneath a roadway (not shown). The loop 10 is electrically engaged to a conventional control box 12 through a coaxial feeder cable 14. The cable has a constant impedance to eliminate this link as a frequency tuning variable as well as reduce the possible interference pickup of stray electrical fields.

The control box 12 may include a programmable apparatus that enables it to operate switching to control traffic signals. Additionally, the box 12 may be tied into centralized apparatus for census purposes, for analyzing flow patterns and for regional, coordinated regulation of traffic flows.

Returning to the loop 10, its straight segments intersect at 16, 18, 20, 22, 24, 26, 28 and 30. The conventional octagonal loop shape is formed by sawing the eight intersecting troughs that comprise its border with flat, circular blades having diamond cutting surfaces.

Semicircular areas 16', 18', 20', 22', 24', 26', 28' and 30' are indicated adjacent the corresponding intersections of the loop 10. Each of such areas represents a portion of the loop 10 that is incapable of providing a reliable indication of traffic flow thereover. Basically, this infirmity of the conventional traffic loop arises from interference between the static fields associated with the intersecting straight segments of the loop conductor. As a result, spurious control signals can be generated and required signals may not be given. The capabilities of the associated control equipment are thereby necessarily limited by the conventional control loop.

Figure 2:
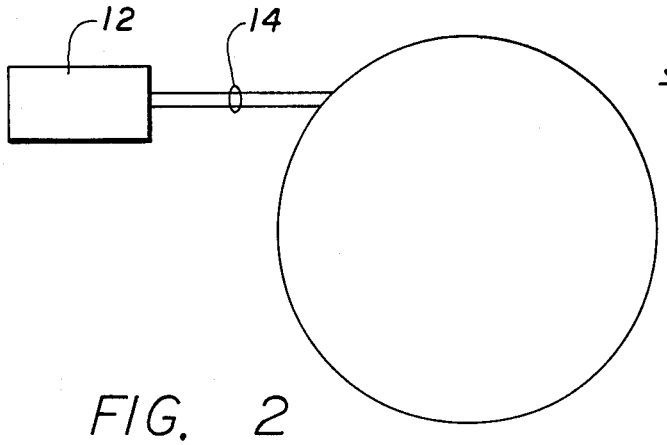
FIG. 2 is a plan view of a traffic loop positioned in a trough formed by means of apparatus in accordance with this invention.

FIG. 2 is a top plan view of a traffic loop configuration of the type that can be rapidly and efficiently achieved by apparatus in accordance with the present invention. As can be seen, the loop 32 is perfectly round. The absence of any corners, resulting from the fabrication of its enclosing trough by means of a circular drill bit as opposed to a flat saw, avoids creation of the points of static field interference that give rise to the insensitivity and unreliability of the prior art loop designs discussed above. Further, the round groove or trough is less subject to shifts in the roadway (especially prevalent in asphalt roads) that, in the case of the conventional trough comprising a plurality of straight segments, can "pinch" the conductive loop. This can result in a decrease in the sensitivity and reliability of detection and, in a worst case, could result in severing of the loop. In either case, additional roadwork maintenance will be required, further increasing the cost of the conventional system.

The theoretical advantages of the circular loop are recognized. However, it has previously been accepted in the art that this "ideal" configuration does not lend itself to practical installation procedures. J. Provenza, "Loop Detector Systems (Part III)" *IMSA Journal* (January/February), page 14.

Figure 3:
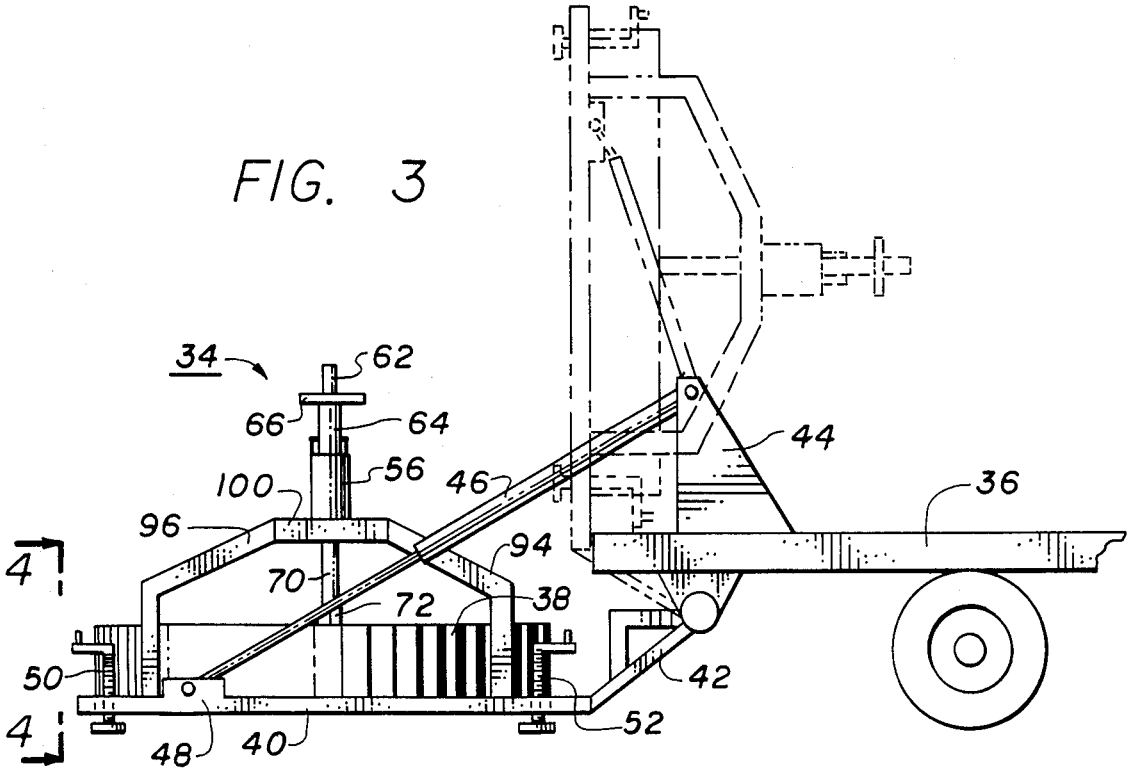
FIG. 3 is a side elevation view of apparatus in accordance with the present invention illustrating the cutting and transport (in shadow) positions.

FIG. 3 is a side elevation view of apparatus in accordance with the invention for rapidly, economically and reliably forming circular roadway troughs to accomplish the advantageous loop configuration of the preceding figure. The apparatus includes a circular drilling rig 34 that is retractably mounted to a movable platform 36 such as the bed of a single axle chassis. Such a chassis, adapted to be towed by a truck cab and including a hydraulic pack for supplying hydraulic power to associated mechanisms (discussed below), is commercially available in either a stake bed or cube body configuration. An example of a chassis (and cab) for use as the movable platform 36 in accordance with this invention is the C-30 of the Chevrolet Corporation.

As can be seen in FIG. 3, the drilling apparatus 34 is retractable, through a ninety degree rotation, between a cutting position (bold outline) and a transport position (shadow outline). The rig 34 includes a six foot diameter circular drill bit 38 that is rotatably mounted to a frame 40. The frame 40 includes a pair of inclined arms 42 for pivotally engaging the underside of the platform 36. A first flange 44 fixed to the upper side of the platform 36 provides a point of pivotal engagement for one end of an extensible hydraulic ram 46 while a second flange 48 fixed to the frame 40 provides a point of pivotal engagement for the opposed or piston end of the ram 46.

The ram 46 and a conventional lift gate-type ram arrangement (not shown) powered by the hydraulic pack of the chassis move the drilling apparatus 34 between the indicated transport and cutting positions. The use of two systems not only provides redundancy in the event of the breach or failure of a hose of the hydraulic system but also assures greater control of the positioning of the bulky cutting apparatus thereby enhancing the reliability and accuracy of the roadway trough cutting process. Hand-operated leveling jacks 50, 52 are further provided for assuring that the drill bit is properly positioned curing the cutting operation.

Figure 4:
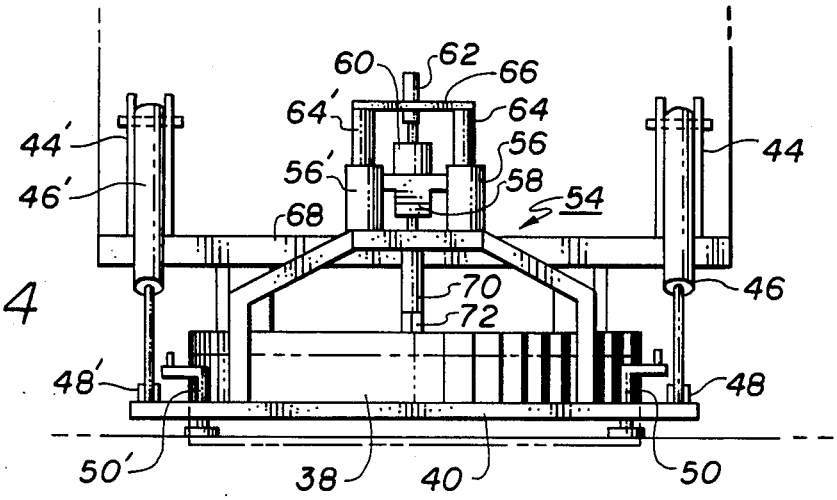
FIG. 4 is a rear elevation view of apparatus in accordance with the invention (cutting position)

FIG. 4 is a rear elevation view of the invention. Certain features, not visible in the preceding figure but corresponding to illustrated features in accordance with the symmetry of the invention, are indicated by corresponding primed numbers. Referring to both FIGS. 3 and 4, the frame 40 includes a framed pulpit 54. The pulpit supports the means for controlling the circular bit 38.

A hydraulically-driven motor 60 provides the source of rotation (preferably 90 r.p.m.) of the bit 38. The motor 60 is retained in a pillar block 58, including an adapter and water seals, that is, in turn, supported between a pair of columns 56, 56' fixed to the top of the pulpit 54. A hydraulic ram 62 for controlling the downward force of the bit 38 is held by an overlying fixture comprising columns 64, 64' (which interlock with columns 56, 56') and crosspiece 66.

Rotation of the shaft of the motor 60 is transferred to the circular bit 38. A one and one-quarter inch diameter threaded shaft 68 that is driven by the motor 60 is engaged to a bit extension 70 that is, in turn, fixed to a hexagonal shaft 72 at the top of the circular drill bit 38. The vertical cutting force of the bit 38 is adjusted in accordance with the downward force exerted by the ram 62 upon the above-described shaft system.

Figure 5:
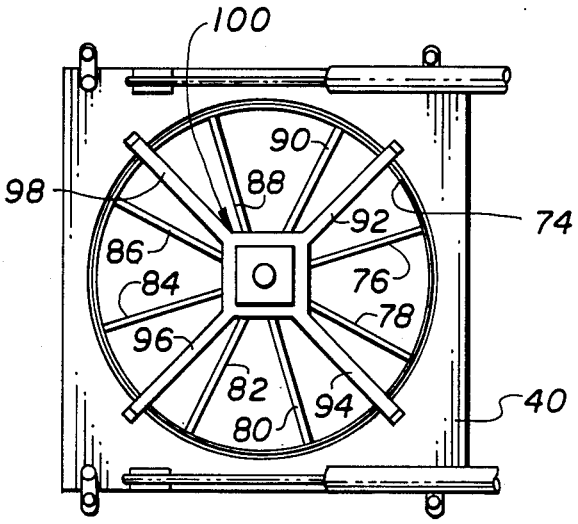
FIG. 5 is a top plan view of the circular drill bit and mounting frame of the invention.

FIG. 5 is a top plan view of the drilling rig 34 of the invention. As can be seen, the frame 40 comprises a seven foot square of one-quarter inch thick diamond pattern plate steel. A six foot, one inch diameter hole 74 in the center of the frame 40 is provided to accommodate the circular drill bit 38.

The cylindrical bit includes a symmetrical array of eight spokes 76, 78, 80, 82, 84, 86, 88 and 90 welded to its top edge. Likewise, the overlying framed pulpit 54 includes four spoke-like frame members 92, 94, 96 and 98 that are welded to the frame 40 and culminate in a square support frame 100 from which the shaft apparatus, described above, is suspended.

Figure 6:
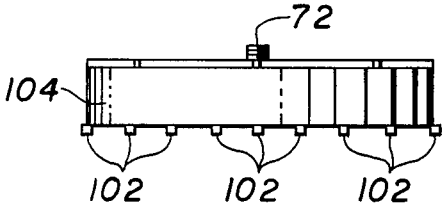
FIG. 6 is a side elevation view of the drill bit of the invention.

FIG. 6 is a side elevation view of the drill bit 38. The cutting surface of the bit is formed by a plurality of one-half inch square segments 102. Each cutting segment is formed of a diamond-cobalt matrix and is silver soldered to the bottom of the cylindrical wall 104 of the bit. As mentioned previously, a plurality of spokes is fixed to the top of the wall 104. The wall of the bit is preferably formed of one quarter thick rolled steel.

Figure 7:
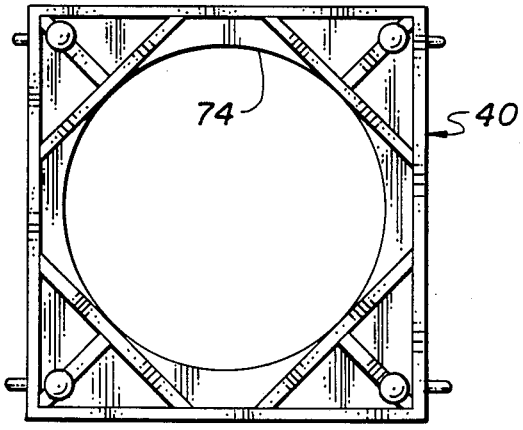
FIG. 7 is a bottom plan view of the drill mounting frame of the invention.

FIG. 7 is a plan view of the underside of the frame 40. In addition to those features already discussed, this view illustrates the pattern of square steel beams that reinforces this element of the invention.

Thus it is seen that new apparatus has been provided for installing traffic detector loops of greater utility than those that may be formed by apparatus of the prior art. By employing the teachings of the invention, one can rapidly (the invention lowers the time per loop from 45 minutes to 5 minutes), accurately and economically provide the circular troughs within roadways that enable the installation of the highly desirable round traffic loop. Previously, the installation of such loops was considered an inherently impractical task.

The apparatus is mobile, including a retractable cutting portion, and therefore readily moved over existing roadways from job to job. By utilizing a circular core or drill bit, the invention possesses an inherent advantage over prior art cutting systems that saw the roadway loop. In a saw, only one or two segments "work" at a given instant of time while a circular drill bit simultaneously employs all of its cutting segments. Thus, in a sense, the invention attains 100 per cent cutting efficiency as opposed to the prior art. Concomitantly, the useful lives of individual cutting segments and, hence, of the cutting implement (500 Iloops per bit vs. 100 loops per blade) are extended significantly. Further, the core drill can be resegmented unlike a planar saw which is subject to stress cracks.

While this invention has been described with regard to its presently preferred embodiment, its scope is by no means limited thereto. Rather, the full scope of the invention is defined by the following set of claims and includes all equivalents thereof.

What is claimed is:

1. Mobile apparatus for cutting a regular circular trough of predetermined width, depth and diameter in a roadway for installing a traffic loop comprising, in combination:

(a) a chassis, said chassis being supported by a set of wheels;

(b) a drill bit having a circular cutting surface in accordance with said predetermined width and diameter;

(c) means for supporting said drill bit, said means for supporting including (i) a substantially planar, rectangular frame including an internal aperture for accommodating the cutting surface of said bit and (ii) a pulpit for supporting the major part of said bit above said frame;

(d) means for driving said last-named means between a traveling position and a cutting position;

(e) said means for supporting being engaged to the rear end of said chassis so that, in said cutting position, said drill bit is outside said set of wheels; and (f) said means for supporting is arranged so that, in said traveling position, the cutting surface of said drill bit is substantially vertical and, in said cutting position, said cutting surface of said drill bit is substantially horizontal.

2. Mobile apparatus as defined in claim 1 wherein said means for driving further includes:

(a) a pair of downwardly-inclined arms for pivotally securing said frame to said chassis so that said frame is beneath the bed of said chassis in said cutting position;

(b) a pair of hydraulic rams;

(c) each of said rams is pivotally engaged, at one end, to said chassis and, at the other end, to said frame; and (d) said pair of rams is arranged so that, when said rams are retracted, said drill bit is driven to said traveling position and, when said rams are extended, said drill bit is stabilized in said cutting position.

3. Mobile apparatus as defined in claim 2 wherein said drill bit further includes:

(a) a hollow cylindrical wall;

(b) a plurality of spokes for supporting the cylindrical shape of said wall; and (c) a plurality of diamond cutting segments are silver soldered to the lower surface of said wall to form said cutting surface.

4. Mobile apparatus as defined in claim 3 further comprising a hydraulically-powered motor for driving said drill bit about its axis of rotation.

5. Mobile apparatus as defined in claim 3 further including manually operable jacks adjacent the corners of said frame for adjusting the attitude of said frame.

* * * * *